US007398750B2

(12) United States Patent
Fujita et al.

(10) Patent No.: US 7,398,750 B2
(45) Date of Patent: Jul. 15, 2008

(54) VALVE MECHANISM FOR INTERNAL COMBUSTION ENGINE

(75) Inventors: Hideo Fujita, Iwata (JP); Koichi Hatamura, Iwata (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 11/363,384

(22) Filed: Feb. 27, 2006

(65) Prior Publication Data

US 2006/0207532 A1 Sep. 21, 2006

Related U.S. Application Data

(63) Continuation of application No. PCT/JP2004/012193, filed on Aug. 25, 2004.

(30) Foreign Application Priority Data

Aug. 22, 2003 (JP) ..... 2003-208466

(51) Int. Cl.
*F01L 1/34* (2006.01)

(52) U.S. Cl. ..... 123/90.16; 123/90.15; 123/90.31

(58) Field of Classification Search ..... 123/90.15, 123/90.16, 90.31
See application file for complete search history.

(56) References Cited

U.S. PATENT DOCUMENTS 4,572,118 A 2/1986 Baguena et al.
4,714,057 A 12/1987 Wichart
5,018,487 A 5/1991 Shinkai
5,189,998 A 3/1993 Hara
5,373,818 A 12/1994 Unger
6,425,357 B2 7/2002 Shimizu et al.

FOREIGN PATENT DOCUMENTS

JP 62-146091 12/1988
JP 04-246790 9/1992
JP 04-177111 1/1994
JP 05-064177 9/1994

(Continued)

OTHER PUBLICATIONS

U.S. Appl. No. 09/773,066, filed Dec. 20, 2001, Himsel.

(Continued)

*Primary Examiner*—Zelalem Eshete
(74) *Attorney, Agent, or Firm*—Knobbe, Martens, Olson & Bear, LLP.

(57) ABSTRACT

A valve drive mechanism is provided for opening and closing a valve of an engine. The device comprises a valve drive device and a swing member pivotally supported on a swing member support shaft. The swing member is driven to pivot about the swing member support shaft by the valve drive device. A cam surface is formed on the swing member. The cam surface is configured to transfer motion of the swing member to a second member of the valve drive device. The cam surface comprises a first portion that is configured to contact the second member while the valve is moving from a closed or substantially closed position to an open position and a second portion configured to contact the second member when the valve is closed or substantially closed. A width of the second portion of the cam surface is smaller than a width of the first portion of the cam surface.

9 Claims, 15 Drawing Sheets

FOREIGN PATENT DOCUMENTS

| | | | | |
|---|---|---|---|---|
| JP | 05-102572 | | | 11/1994 |
| JP | 05-328072 | | | 3/1995 |
| JP | 06-060942 | | | 5/1995 |
| JP | 06-088455 | | | 11/1995 |
| JP | 09-212497 | | | 2/1999 |
| JP | 2001-300725 | | | 4/2003 |
| JP | 2002-040455 | | | 8/2003 |
| WO | WO 02/92972 | | * | 4/2002 |
| WO | WO 2004/097186 | A1 | | 11/2004 |
| WO | WO 2005/019607 | A1 | | 3/2005 |
| WO | WO 2005/019609 | A1 | | 3/2005 |

OTHER PUBLICATIONS

U.S. Appl. No. 10/990,557, filed Nov. 17, 2004, Fujita et al.
U.S. Appl. No. 11/263,528, filed Oct. 31, 2005, Fujita et al.
U.S. Appl. No. 11/263,573, filed Oct. 31, 2005, Fujita et al.
PCT International Search Report regarding PCT/JP2004/006426 mailed Aug. 3, 2004.
PCT International Search Report regarding PCT/JP2004/006428 mailed Aug. 17, 2004.
PCT International Search Report regarding PCT/JP2004/012193 mailed Nov. 2, 2004.

* cited by examiner

VALVE MECHANISM FOR INTERNAL COMBUSTION ENGINE

PRIORITY INFORMATION

This application is a continuation of PCT Application No. 2004JP12193, filed on Aug. 25, 2004, the entire contents of this application is expressly incorporated by reference herein.

BACKGROUND OF THE INVENTION

1. Field of the Invention

The present invention relates to a valve drive mechanism and, more particularly, to a valve drive mechanism for an internal combustion engine.

2. Description of the Related Art

One type of valve drive mechanism for an internal combustion engine comprises a camshaft, which drives an intake and/or exhaust valve to open and close through a rocker arm. A swing member or rocking member is positioned between the rocker arm and the camshaft. The swing member is rocked back and forth by a rotating cam that is provided on the camshaft. A cam surface on the swing member comes into contact with a cam surface on the rocking arm. Thus, when the swing member is rocked or swung back and forth, this motion is transferred to the rocker arm causing it to be rocked back and forth. This reciprocal motion causes the rocker arm to press against the intake and/or exhaust valve to open/close the valve. JP-A-H7-063023 describes such a valve mechanism.

SUMMARY OF THE INVENTION

One aspect of the present invention is the recognition that in such a conventional valve mechanism, the cam surface of the swing member has a base circle portion, a lift portion and a ramp portion for connecting therebetween. The cam surface requires a certain width to provide sufficient strength to withstand a large force acting on the cam surface. This results in an increase in weight of the swing member on its distal end side, causing an increase in inertia force of the swing member which undergoes reciprocating motion. Accordingly, other parts associated with the swing member also need to provide sufficient strength, also causing increases in weight of the parts as well as in size of the entire system. This creates additional problem with an increase in wear on a contact portion of the swing member.

In the view of the above, an aspect of the present invention is t solve the above-mentioned problems of the prior art. Accordingly, it is an object of the present invention to provide a swing member and a valve mechanism for an internal combustion engine, which can achieve reductions in size and weight as well as in wear on a contact portion of the swing member.

Accordingly, one aspect of the present invention comprises a swing member that is configured for reciprocal motion within a valve train device an engine. The swing member comprises a cam surface that includes a contact surface that includes a base circle portion and a lift portion. A width of the base circle portion of the contact surface is smaller than a width of the lift portion of the contact surface.

Another aspect of the present invention comprises a valve drive mechanism for actuating a valve of an internal combustion engine. The mechanism includes a camshaft that is rotated by a crankshaft of the internal combustion engine. A cam is coupled to the camshaft. A swing member support shaft is positioned substantially in parallel to the camshaft. A swing member is supported for pivotal motion on the swing member support shaft and is configured to be actuated for reciprocal motion by the cam. The swing member includes a cam surface that has a base circle portion and a lift portion. A width of the base circle portion of the cam surface is smaller than a width of the lift portion of the cam surface.

Accordingly, one aspect of the present invention comprises A valve drive mechanism is provided for opening and closing a valve of an engine. The device comprises a valve drive device and a swing member pivotally supported on a swing member support shaft. The swing member is driven to pivot about the swing member support shaft by the valve drive device. A cam surface is formed on the swing member. The cam surface is configured to transfer motion of the swing member to a second member of the valve drive device. The cam surface comprises a first portion that is configured to contact the second member while the valve is moving from a closed or substantially closed position to an open position and a second portion configured to contact the second member when the valve is closed or substantially closed. A width of the second portion of the cam surface is smaller than a width of the first portion of the cam surface.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

A general architecture that implements various features of specific embodiments of the invention will now be described with reference to the drawings. The drawings and the associated descriptions are provided to illustrate embodiments of the invention and not to limit the scope of the invention.

DETAILED DESCRIPTION OF THE PREFERRED EMBODIMENTS

Embodiments of the present invention will be described with reference to the drawings.

Figure 1:
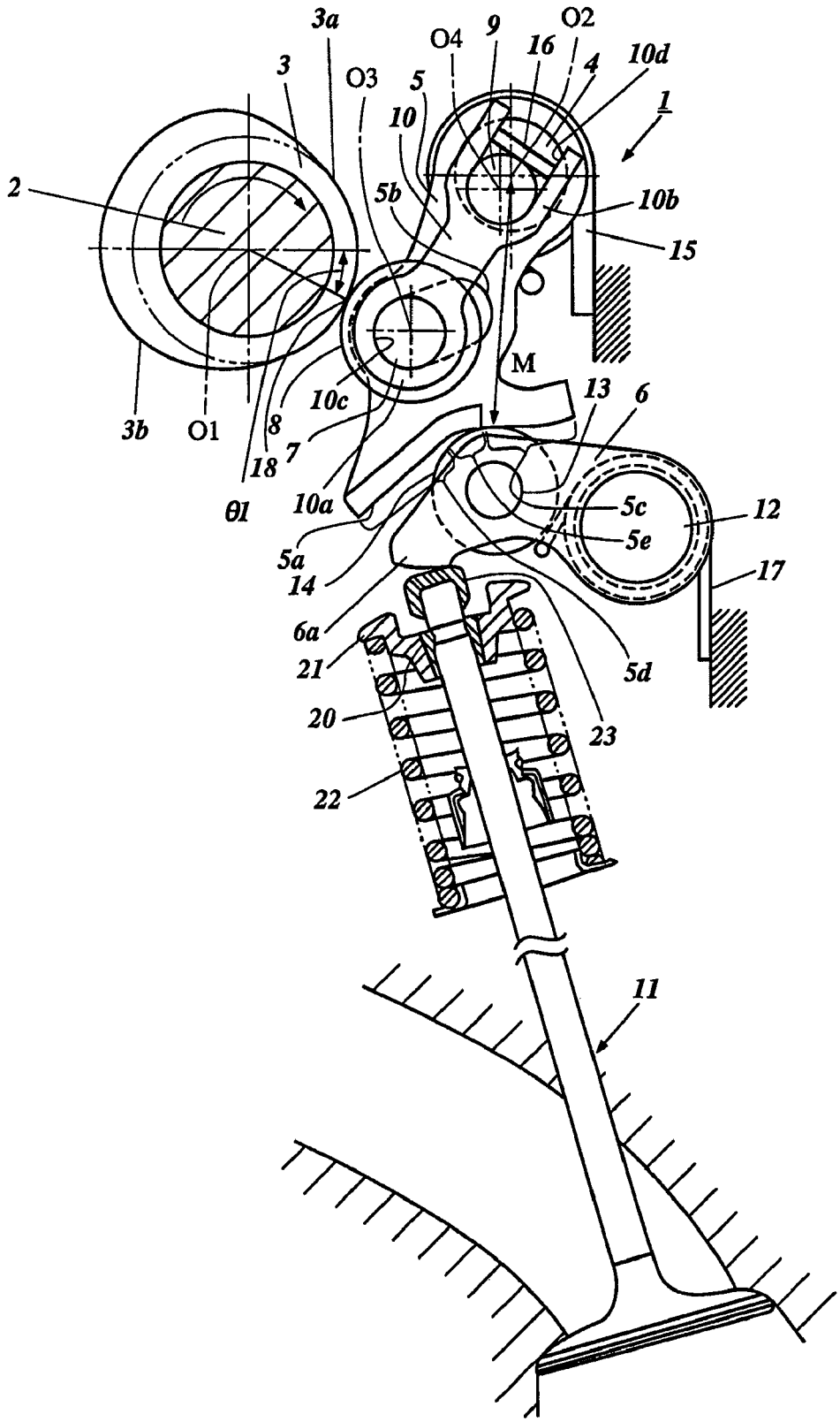
FIG. 1 is a cross-sectional side view a variable valve mechanism in a state in which maximum lift is required and the intake valve is closed.

FIGS. 1 through 5 describe a first embodiment of the invention. In FIG. 1, reference numeral 1 denotes a valve drive mechanism for an intake valve 11 of an internal combustion gasoline engine. As shown, the valve drive mechanism 1 can include a valve drive device 2, which in the illustrated embodiment is in the form of a camshaft 2, which is rotated by a crankshaft (not shown) of the internal combustion engine. A rotating cam 3 can be provided on the camshaft 2. A rocking or swinging member support shaft 4 can be provided in parallel to the camshaft 2. A rocking or swinging member 5 can be pivotally supported on the rocking shaft 4 and can be adapted to rock and/or swing through contact with the rotating cam 3. A rocker arm 6 can be provided and arranged such that it is rocked or swung in synchronization with the swing member 5 to open/close the intake valve 11.

In the embodiments described below, reference will be made to the intake valve 11. However, it should be appreciated that certain features and aspects of these embodiments may also be applied to an exhaust valve. It should also be appreciated that various features, aspects and advantages of the present invention may be used with engines having more than one intake valve and/or exhaust valve, and any of a variety of configurations including a variety of numbers of cylinders and cylinder arrangements (V, W, opposing, etc.). In one embodiment, the construction of the valve drive mechanism 1 can be the same or substantially similar between the intake valve 11 and exhaust valve of the engine. Accordingly, the description of the valve drive mechanism herein will focus on the intake valve side and the exhaust valve side will be omitted.

As shown in FIG. 1, the camshaft or valve drive 2 can be arranged with its longitudinal direction extending toward the front and back (i.e. in the direction perpendicular to the plane) of FIG. 1. The camshaft 2 can be rotated about a center axis O1 at a half the rotational speed of that of the crankshaft of the internal combustion engine. In turn, the rotating cam 3 can be fixed onto the outer peripheral surface of the camshaft 2. As shown in FIG. 1, the outer peripheral portion thereof can be configured with a base surface 3*a* that is arc-shaped in plan view, and a nose surface 3*b* projecting from the base surface 3*a*. A center axis O2 of the rocking shaft 4 can be arranged in parallel to the center axis O1 of the camshaft 2.

The rocking or swing member 5 can be engaged with the outer peripheral surface of the rocking shaft 4, and can be supported to be rockable or pivotable about the center axis O2 of the rocking shaft 4. A cam or contact surface 5*a* for rocking the rocker arm 6 can be formed in the lower end portion of the swing member 5.

As shown in FIGS. 1 through 5, the cam or contact surface 5*a* can include an arc-shaped base circle portion 5*c* around the center axis O2, a lift portion 5*d* for rocking the rocker arm 6, and a ramp portion 5*e* positioned between the lift portion 5*d* and the base circle portion 5*c*. In general, the lift portion 5*d* is configured to contact the rocker arm 6 while the intake valve II valve is an open position and the arc-shaped base circle portion 5*c* is configured to contact the rocker arm 6 when the valve 11 is closed or substantially closed.

Figure 5A:
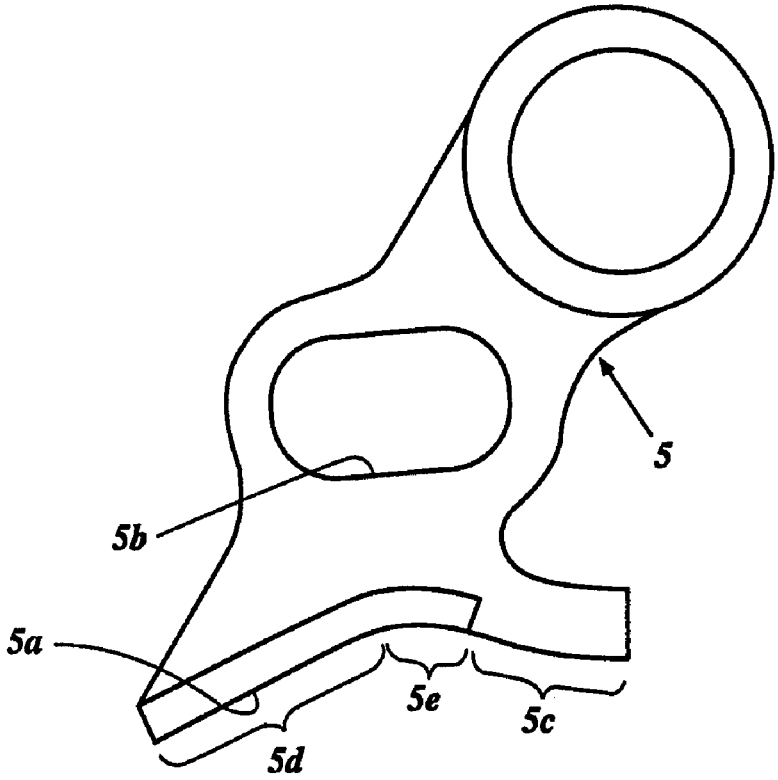
FIGS. 5(*a*) and 5(*b*) are front and bottom views respectively of a swing member of the variable valve mechanism of FIG. 1.
Figure 5B:
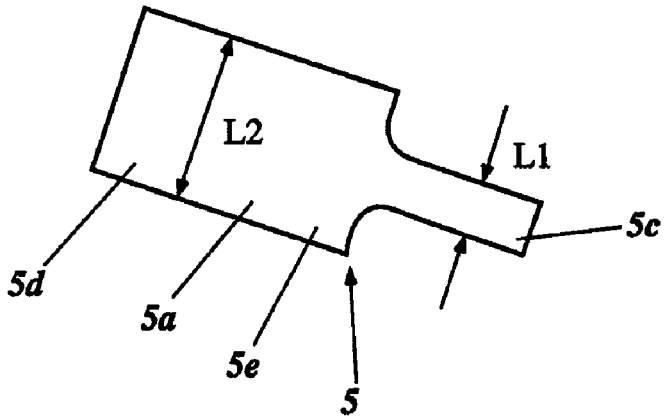

Advantageously, as shown in FIG. 5, a width L1 of a contact surface of the base circle portion 5*c* is smaller than a width L2 of a contact surface of the lift portion 5*d*. In one embodiment, the width L1 of the base circle portion 5*c* is at least 50% smaller than the width L2 than the lift portion 5*d*.

With reference to FIGS. 1 and 5, a guide portion 5*b*, which can be in a form of an elongate through-hole, can be formed at the longitudinally middle portion of the swing member 5. A roller shaft 7, which has a center axis O3 in parallel to the center axis O2 of a rocking shaft 4, can be movably inserted through the guide portion 5*b*. Provided to the roller shaft 7 is a roller 8, which can form a "rotating cam abutting portion" that contacts and operates in synchronization with a base surface 3*a* or a nose surface 3*b* of the rotating cam 3, for transmitting the drive force from the rotating cam 3 to the swing member 5.

The guide portion 5*b* is formed in the shape of an elongate hole so as to guide the roller shaft 7 along its longitudinal direction over a predetermined distance, and the guiding direction at this time can be inclined with respect to the radial direction of the camshaft 2.

As shown in FIG. 1, the roller 8 can be formed in a circular shape, and can be arranged on the outer peripheral surface of the roller shaft 7 so that the center axis of the roller 8 becomes the same as the center axis O3 of the roller shaft 7. The outer peripheral surface of the roller 8 can be capable of rolling on the base surface 3*a* and nose surface 3*b* of the swing member 3.

In such manner, "the rotating cam abutment portion" which abuts the rotating cam 3 can be formed in the shape of a roller to rotate on the rotating cam 3 face. This can reduce the loss of the drive force transmitted from the rotating cam 3 to "the rotating cam abutment portion."

The "the rotating cam abutment portion" is the roller 8 in modified embodiments need not rotate on the rotating cam 3 face. For example, the rotating cam abutment portion can be one which is configured to slide on the rotating cam 3 face to transmit the drive force from the rotating cam 3 to the swing member 5.

With continued reference to FIG. 1, a spring or biasing member 15 for urging the swing member 5 toward the rotating cam 3 side can be provided in fitting engagement with the rocking shaft 4. Thus, the swing member 5 can be urged toward the rotating cam 3 side by the urging force of the spring 15, so that the outer peripheral surface of the roller 8 is in constant contact with the base surface 3*a* or nose surface 3*b* of the rotating cam 3.

The variable valve mechanism 1 can be provided with "a variable abutment portion mechanism" for making the relative distance between the roller 8 and the center axis O2 of the rocking shaft 4 variable. In the illustrated embodiment, "the variable abutment portion mechanism" comprises a drive shaft 9 coupled onto the rocking shaft 4, and an arm 10 whose one end portion 10*a* is coupled to the roller shaft 7 and whose other end portion 10*b* is coupled to the drive shaft 9.

The drive shaft 9 can be provided on the rocking shaft 4 in such a manner that a center axis O4 thereof is located in parallel and eccentrically to the center axis O2 of the rocking shaft 4.

Further, an actuator (not shown) for rotating the rocking shaft 4 within a predetermined angle range about the center axis O2 can be coupled to one end portion of the rocking shaft 4. Coupled to the actuator is a control device (not shown) for controlling the angle of the actuator according to the operational state of the internal combustion engine.

Thus, when the rocking shaft 4 turns by a predetermined angle, the drive shaft 9 turns by a predetermined angle about the center axis O2 of the rocking shaft 4, whereby the position of the center axis O4 changes relative to the center axis O2 of the rocking shaft 4.

In the illustrated embodiment, the arm 10 is preferably capable of keeping the distance between the center axis O3 of the roller shaft 7 and the center axis O4 of the drive shaft 9 constant. A through-hole 10*c*, with which the roller shaft 7 is fitted, can be formed at the one end portion 10*a* of the arm 10, and an insertion portion 10*d*, into which the drive shaft 9 is inserted and which is partially open, can be formed at the other end portion 10*b* thereof. Accordingly, the roller shaft 7 can be rotatably fitted with the through-hole 10*c* at the one end portion 10*a*, and the drive shaft 9 can be rotatably fitted with the insertion portion 10*d* at the other end portion 10*b* and mounted in place with a pin 16 so as to prevent dislodging thereof.

Thus, in operation, when the rocking shaft 4 is rotated by a predetermined angle by the actuator, the drive shaft 9 provided to the rocking shaft 4 is turned by a predetermined angle about the center axis O2 of the rocking shaft 4, and the roller shaft 7 is operated in synchronization with this turning movement through the arm 10. The roller shaft 7 is thus moved within the guide portion 5*b* while keeping the distance between the center axis O3 of the roller shaft 7 and the center axis O4 of the drive shaft 9 constant with the arm 10. Thereby, the relative distance between the center axis O2 of the rocking shaft 4 and the roller 8 can be made variable.

As shown in FIG. 1, the rocker arm 6 can be disposed below the swing member 5 while being rockably supported on the rocker arm shaft 12. Although the rocker arm 6 is illustrated as being rockably supported by the rocker arm shaft 12, the invention is not limited to this configuration. For example, the rocker arm 6 can be rockably supported with a spherical pivot, hydraulic lash adjuster, or the like.

A valve pressing portion 6*a* is formed at the distal end portion of the rocker arm 6 for pressing on the upper surface of a shim 23 fitted on an intake valve 11 which will be described later. A roller 14 can be rotatably provided on the roller shaft 13, and the outer peripheral surface of the roller 14 can be capable of rolling on the cam surface 5*a* of the swing member 5. In modified embodiments, the roller 14 can be substituted with a sliding element.

A spring or biasing member 17 for urging the rocker arm 6 toward the swing member 5 side can be in fitting engagement with the rocker arm shaft 12. Thus, the rocker arm 6 can urged toward the swing member 5 side by the spring 17, so that the outer peripheral surface of the roller 14 can be in constant contact with the cam surface 5*a* of the swing member 5. The intake valve 11 can pressed by the valve pressing portion 6*a* the rocker arm 6 to move the valve 11 in a generally vertical direction.

The intake valve 11 can have a collet 20 and an upper retainer 21 that are provided in its upper portion. A valve spring or biasing member 22 can arranged below the upper retainer 21. The intake valve 11 can be urged toward the rocker arm 6 side by the urging force of the valve spring 22. A shim 23 can be fitted on the upper end portion of the intake valve 11.

Accordingly, in operation, the intake valve 11 can be vertically moved by rocking the rocker arm 6 in synchronization with the rocking motion of the swing member 5. Thus, by making the relative distance between the center axis O2 of the swing member 4 and the roller 8 variable to adjust the rocking start position of the swing member 5, the lift amount and the maximum lift timing of the intake valve 11 can be adjusted and made variable through the rocker arm 6.

Figure 2:
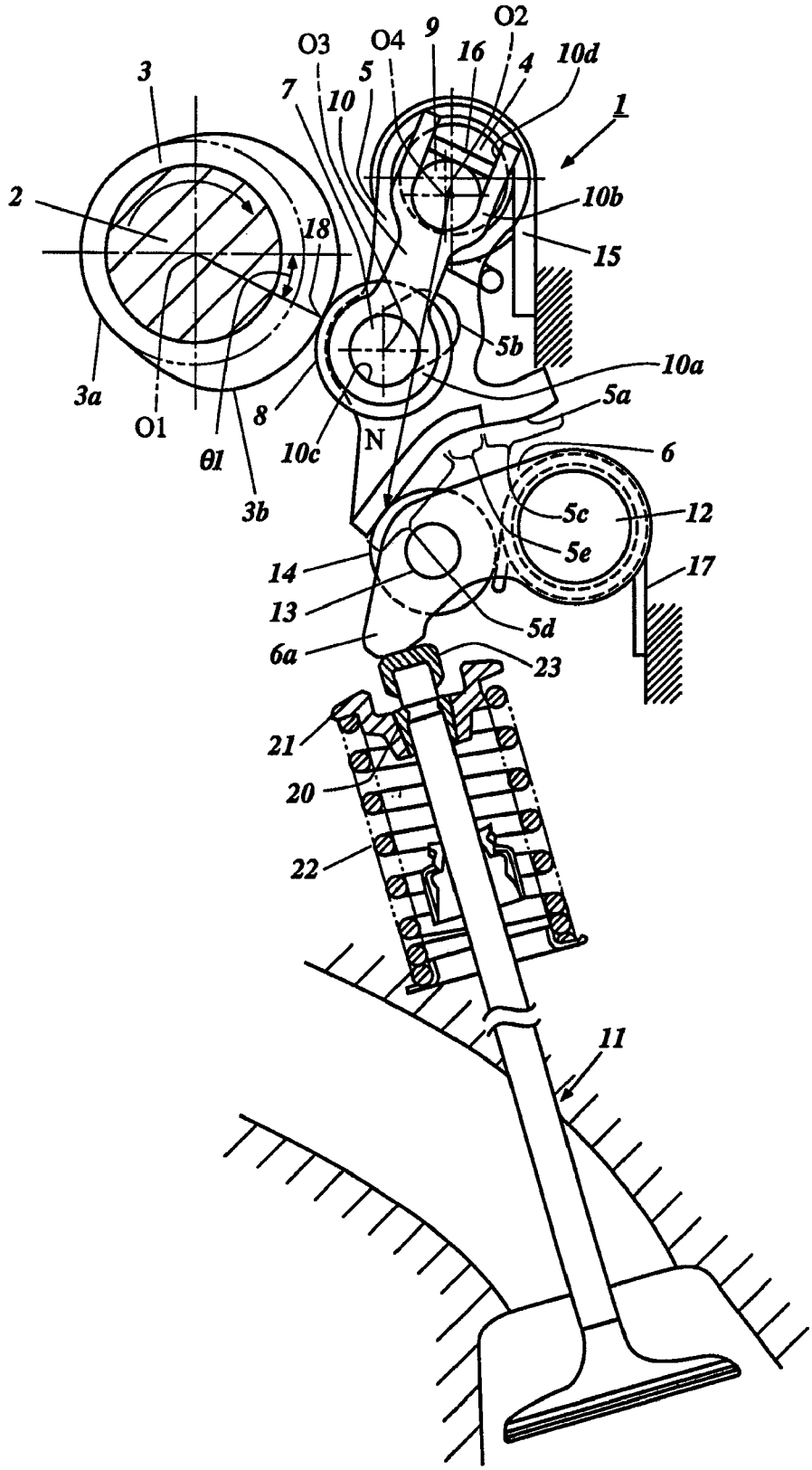
FIG. 2 is a cross-sectional side view of the variable valve mechanism of FIG. 1 in a state in which maximum lift is required the intake valve is open.

The operation of the variable valve mechanism 1 will now be described in more detail. First, with reference to FIGS. 1 and 2, a detailed description will be made on the operation of the variable valve mechanism 1 when the maximum lift amount is required. Here, FIG. 1 is shows the variable valve mechanism when the maximum lift amount is required and the intake valve 11 is closed. FIG. 2 shows the variable valve mechanism 1 when the maximum lift amount is required and the intake valve 11 is open.

First, as shown in FIG. 1, the roller shaft 7 is moved to the rotating cam 3 side end portion of the guide portion 5*b*, thereby changing the relative distance between the center axis O2 of the rocking shaft 4 and the roller 8. That is, the rocking shaft 4 is turned by a predetermined angle by the actuator, causing the drive shaft 9 to move in the circumferential direction of the rocking shaft 4. Thus, the roller shaft 7 is operated in synchronization with this movement via the arm 10 to be moved to the rotating cam 3-side end portion of the guide portion 5*b*, whereby the relative distance between the center axis O2 of the rocking shaft 4 and the roller 8 changes.

Further, as shown in FIG. 1, while the roller 8 of the swing member 5 is in contact with the base surface 3*a* of the rotating cam 3, the swing member 5 is not rocked to the intake valve 11 side, the rocker arm 6 is urged to the swing member 5 side by the urging force of the spring 17, and also the intake valve 11 is urged to the rocker arm 6 side by the urging force of the valve spring 22. Thus, the lift of the intake valve 11 does not occur and the intake valve 11 is brought into a closed state.

In this state, the roller 14 is located at the position corresponding to the base circle portion 5*c* of the cam surface 5*a* of the swing member 5. Since no large abutment force acts between the roller 14 and the base circle portion 5*c* in the valve closure state, a sufficient durability can be secured even through the width L1 of the base circle portion 5*c* is small.

Then, when the rotating cam 3 is rotated via the camshaft 2 due to the rotation of the crankshaft of the internal combustion engine, as shown in FIG. 2, the roller 8 is pressed on by the nose surface 3*b*. As the roller 8 is further pressed, the swing member 5 is pressed via the roller shaft 7, causing the swing member 5 to rock counterclockwise in FIG. 1 against the urging force of the spring 15.

Through the rocking movement of the swing member 5, the portion of the cam surface 5*a* of the swing member 5 which presses the roller 14 changes from the base circle portion 5*c* to the lift portion 5*d* via the ramp portion 5*e*, and the rocker arm 6 is turned via the roller shaft 13 to the intake valve 11 side. In this way, a relative distance M between the center axis O2 of the rocking shaft 4 and the roller 14 in contact with the cam surface 5*a* of the swing member 5 as shown in FIG. 1 is largely changed to a relative distance N between the center axis O2 of the rocking shaft 4 and the roller 14 in contact with the cam surface 5*a* of the swing member 5 as shown in FIG. 2. The rocker arm 6 thus undergoes large rocking movement to the intake valve 6 side.

Then, the valve pressing portion 6*a* formed at the distal end portion of the rocker arm 6 that has thus undergone large rocking movement to the intake valve 11 side presses on the upper surface of the shim 23 to push down the intake valve 11 by a large distance. As described above, by moving the roller shaft 7 to the end portion of the guide portion 5*b* in the rotating cam 3 side to make the relative distance between the center axis O2 of the rocking shaft 4 and the roller 8 variable, the relative distance between the center axis O2 of the rocking shaft 4 and the roller 14 in contact with the cam surface 5*a* of the swing member 5 can be largely changed, whereby the intake valve 11 can be pushed down by a large distance to bring the intake valve 11 into an open state at the maximum lift amount.

In the case where the intake valve 11 is opened in this way, the width L2 of the lift portion 5*d* is made large because a large reaction force acts on the cam surface 5*a* of the swing member 5, thereby making it possible to provide increased strength.

Next, detailed description will be made on the operation of the variable valve mechanism 1 of the internal combustion engine when a minimum lift amount is required, with reference to FIGS. 3 and 4.

Figure 3:
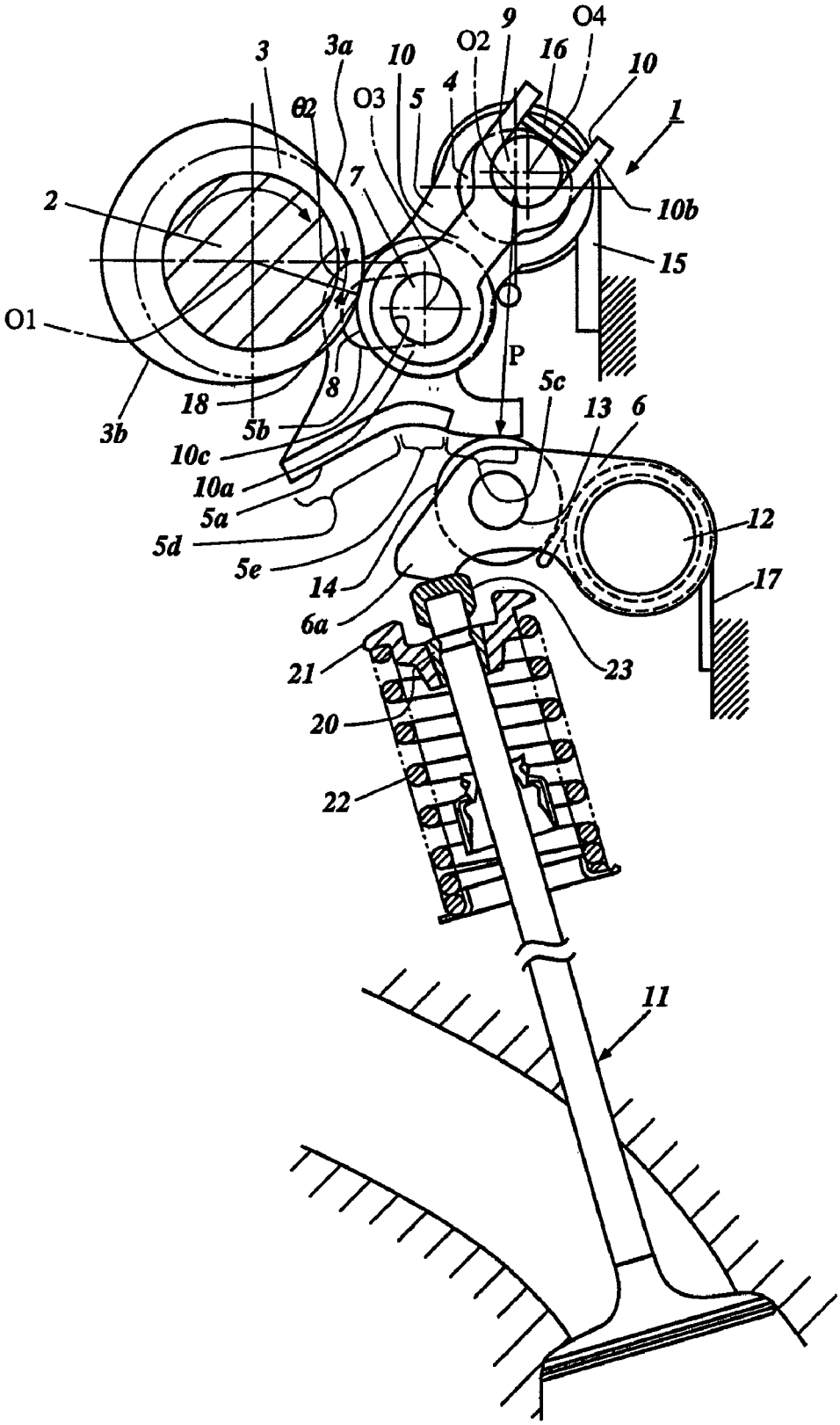
FIG. 3 is a cross-sectional side view of variable valve mechanism of FIG. 1 in a state in which minimum lift amount is required and the intake valve is closed.

Here, FIG. 3 is a cross-sectional view of the variable valve mechanism 1 when minimum lift amount is required and the intake valve is closed. FIG. 4 is a cross-sectional of the variable valve mechanism 11 when the minimum lift amount is required and the intake valve is open.]

First, as shown in FIG. 3, in the state as shown in FIG. 1 where the roller shaft 7 is retained at the rotating cam 3-side end portion, the roller shaft 7 is moved to the rocking shaft 4-side end portion of the guide portion 5*b*, thereby changing the relative distance between the center axis O2 of the rocking shaft 4 and the roller 8.

That is, the rocking shaft 4 is turned within a predetermined angle range by the actuator, causing the drive shaft 9 to move in the circumferential direction of the rocking shaft 4. Accordingly, the roller shaft 7 is operated in synchronization with this movement via the arm 10 so that the roller shaft 7 is moved to the rocking shaft 4-side end portion of the guide portion 5*b* from the state where it is retained at the rotating cam 3-side end portion, whereby the relative distance between the center axis O2 of the rocking shaft 4 and the roller 8 decreases. Then, the swing member 5 turns from the position as shown in FIG. 1 to the position as shown in FIG. 3 due to the urging force of the spring 15.

Further, as shown in FIG. 3, while the roller 8 provided to the swing member 5 is in contact with the base surface 3*a* of the rotating cam 3, the swing member 5 is not rocked to the intake valve 11 side, the rocker arm 6 is urged to the swing member 5 side by the urging force of the spring 17, and also the intake valve 11 is urged to the rocker arm 6 side by the urging force of the valve spring 22. Thus, the lift of the intake valve 11 does not occur and the intake valve 11 is brought into a closed state.

Figure 4:
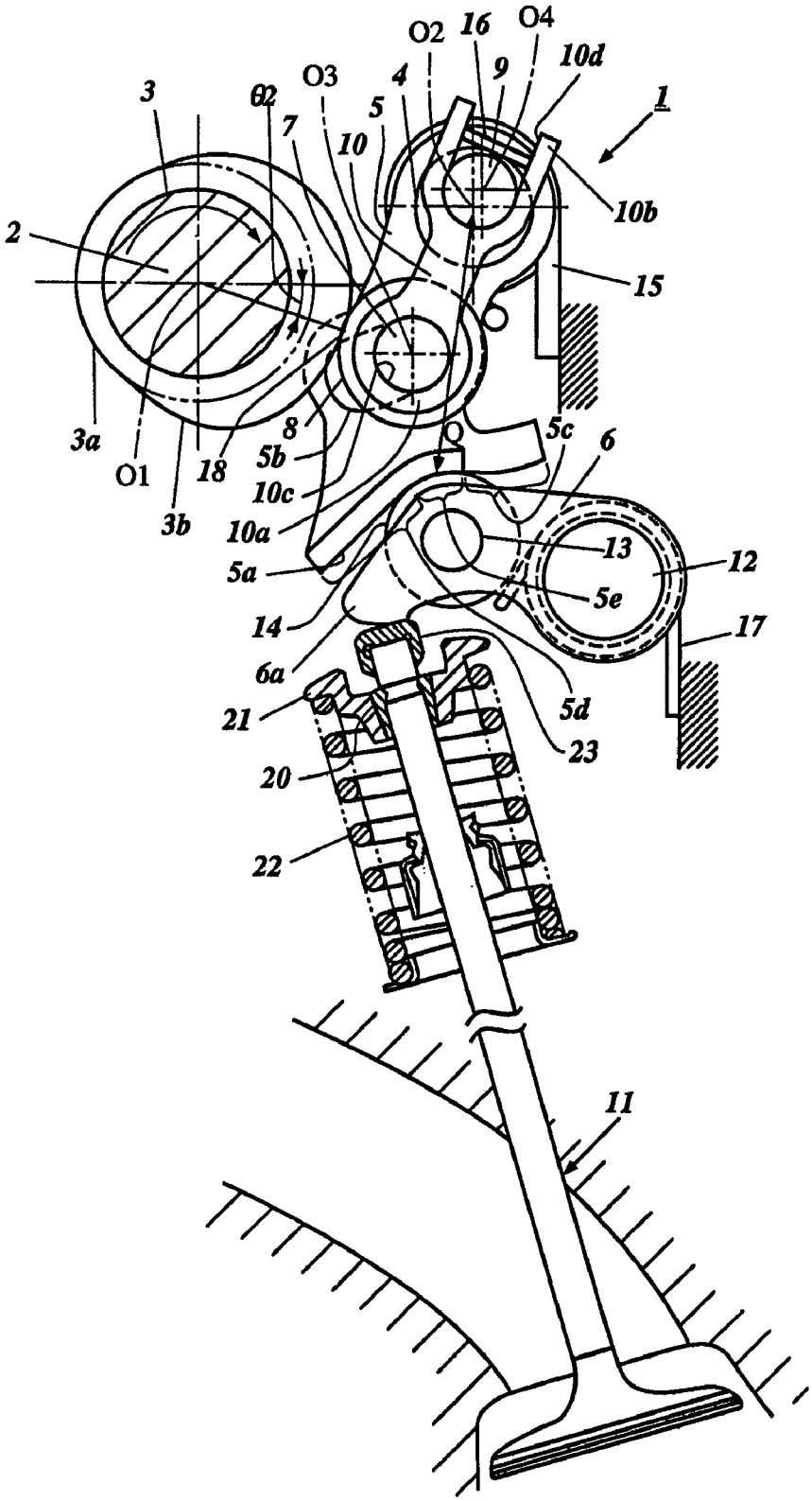
FIG. 4 is a cross-sectional side view of the variable valve mechanism of FIG. 1 in a state in which minimum lift amount is required and the intake valve is open.

When the rotating cam 3 is rotated via the camshaft 2 due to the rotation of the crankshaft of the internal combustion engine, as shown in FIG. 4, the roller 8 is pressed on by the nose surface 3*b*, and the swing member 5 is pressed via the roller shaft 7, causing the swing member 5 to rock counterclockwise in FIG. 3 against the urging force of the spring 15.

As the swing member 5 is further rocked, the roller 14 in contact with the rocking shaft 4-side distal end portion of the cam surface 5*a* of the swing member 5 is pushed down to the intake valve 11 side by using the range of the cam surface 5*a* from the rocking shaft 4-side distal end portion to the center portion thereof, whereby the rocker arm 6 is rocked to the intake valve 11 side via the roller shaft 13. In this way, a relative distance P between the center axis O2 of the rocking shaft 4 and the roller 14 in contact with the cam surface 5*a* of the swing member 5 as shown in FIG. 3 undergoes a small change to become a relative distance Q between the center axis O2 of the rocking shaft 4 and the roller 14 in contact with the cam surface 5*a* of the swing member 5 as shown in FIG. 4. The rocker arm 6 thus undergoes small rocking movement to the intake valve side.

Then, the valve pressing portion 6*a* formed at the distal end portion of the rocker arm 6 that has thus undergone small rocking movement to the intake valve 11 side presses on the upper surface of the shim 23 to push down the intake valve 11 by a small distance. In this way, by moving the roller shaft 7 to the rocking shaft 4-side end portion of the guide portion 5*b* to make the relative distance between the center axis O2 of the rocking shaft 4 and the roller 8 variable, the relative distance between the center axis O2 of the rocking shaft 4 and the roller 14 in contact with the cam surface 5*a* of the swing member 5 can be subjected to a small change to push down the intake valve 11 by a small distance, whereby, in this embodiment, the intake valve 11 can be brought into an open state at the minimum lift amount.

Further, although the width L1 of the base circle portion 5*c* is small, since no large load acts on this portion, a requisite strength can be secured for the base circle portion 5*c*. Because a large load acts on the lift portion 5*d*, the width L2 thereof is made larger to secure a requisite strength.

Advantageously, the weight of the swing member 5 can be reduced because of the small width L1 of the base circle portion 5*c*. This results in a reduction in inertia force of the swing member 5 at the time of rocking movement, as well as in a reduction in weight of parts associated with the swing member 5 (e.g. spring 15). This allows the whole system to be smaller while reducing wear on a contact portion of the cam surface 5*a*.

Particularly, the base circle portion 5*c* is formed in a position apart from the center axis O2, and therefore can more contribute to the reduced inertia force.

In the variable valve mechanism 1 of the internal combustion engine constructed as described above, the swing member 5 can be provided with the roller 8 or the rotating cam abutment portion that comes into contact with the rotating cam 3 to transmit the drive force from the rotating cam to the swing member 5. The valve mechanism 1 can be provided with the variable abutment portion mechanism for making the relative distance between the roller 8 and the center axis O2 of the rocking shaft 4 variable by making the roller 8 movable; the lift amount or the like of each valve is made variable by thus making the relative distance variable, whereby the structure can be simplified to achieve low-cost construction.

Further, the load from the rotating cam 3 can be inputted to the roller 8, and the load can be directly transmitted from the roller 8 to the guide portion 5*a* of the swing member 5. Then, the load is transmitted from the swing member 5 to the intake valve 11 via the rocker arm 6. Thus, no large load acts on the arm 10 that supports the roller 8, and since the arm 10 serves the sole function of moving the roller 8 along the guide portion 5*a*, not so large strength is required for the arm 10.

Figure 6:
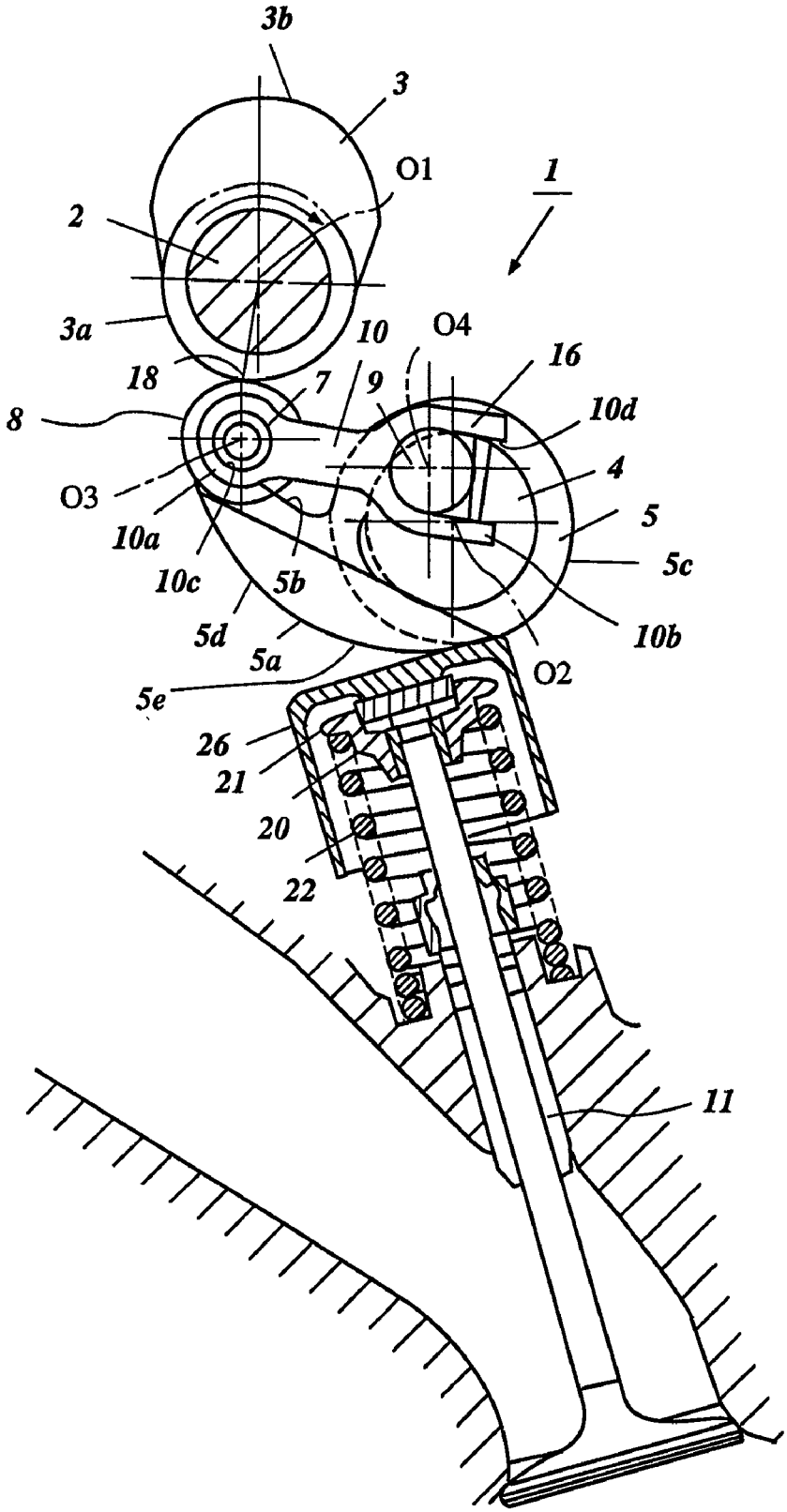
FIG. 6 is a cross-sectional side view of another embodiment of a variable valve mechanism in a state in which maximum lift amount is required and the intake valve is closed.
Figure 7:
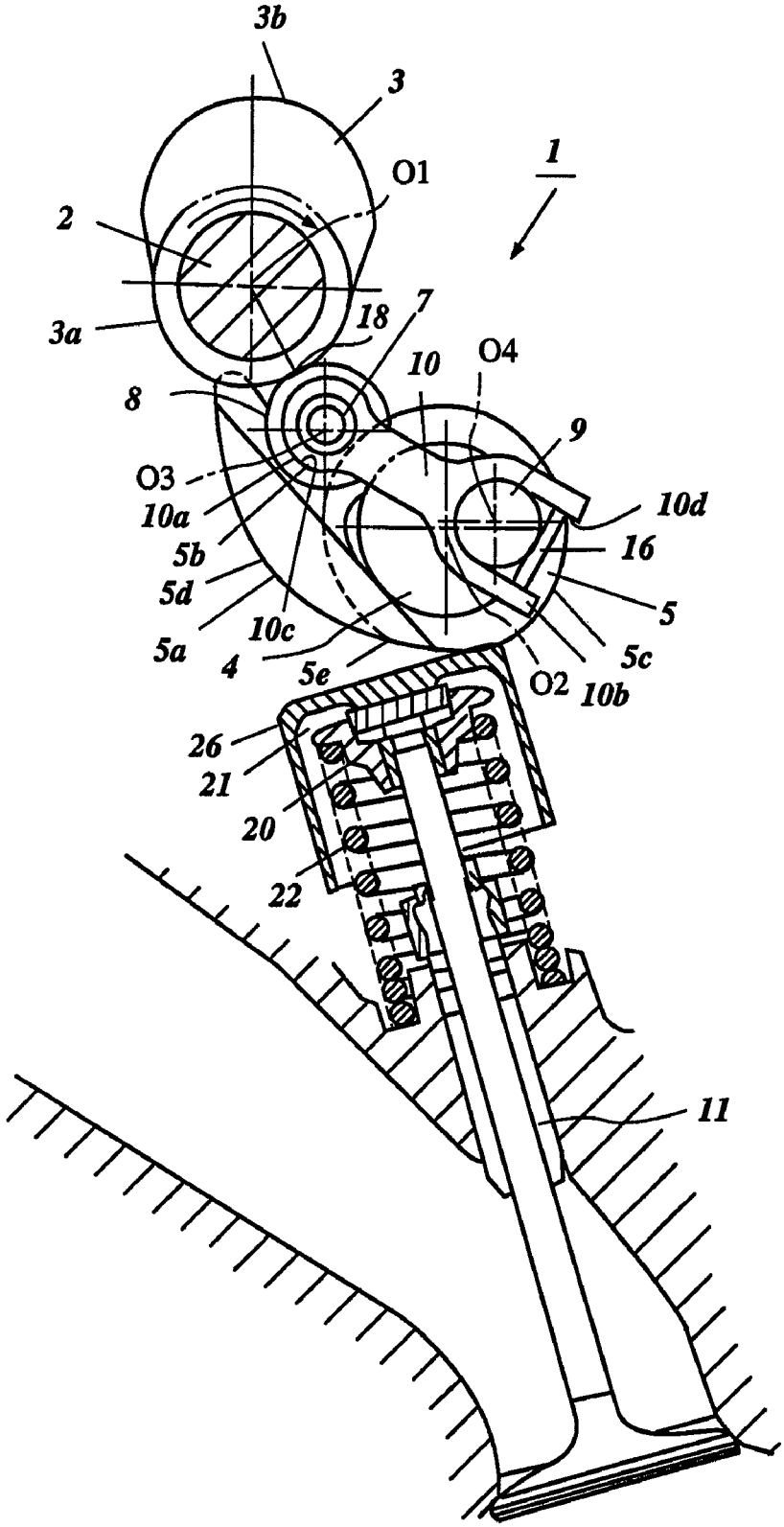
FIG. 7 is a cross-sectional side view of the variable valve mechanism of FIG. 6 in a state in which minimum lift amount is required and the intake valve is closed.
Figure 8A:
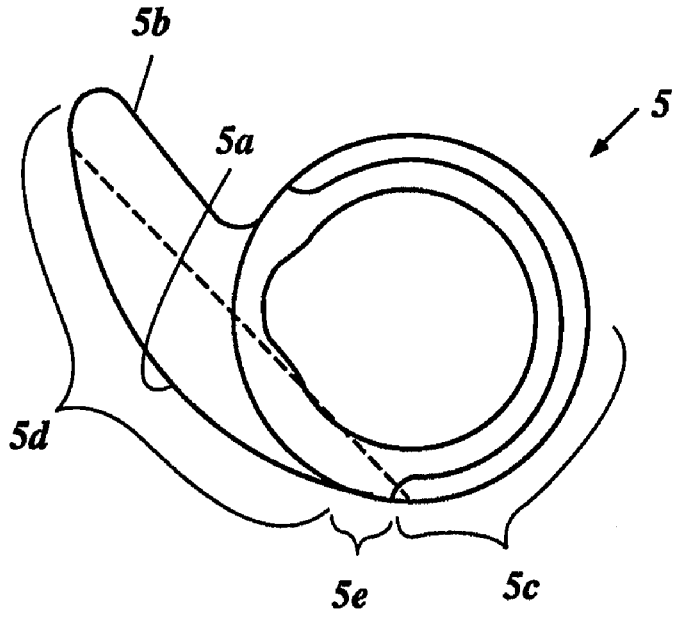
FIGS. 8(*a*) and 8(*b*) are front and bottom views respectively of a swing member of the variable valve mechanism of FIG. 6.
Figure 8B:
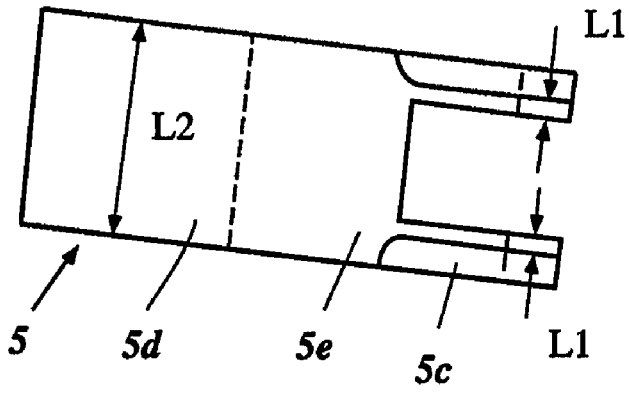

FIGS. 6-8 illustrate another embodiment of a variable valve timing mechanism 1. FIG. 6 is a cross-sectional view of the variable valve mechanism 1 when maximum lift amount is required and the intake valve is closed. FIG. 7 is a cross-sectional view of the variable valve mechanism 1 when the minimum lift amount is required and the intake valve is closed.

In this embodiment, the rocker arm 6 which opens and closes an intake valve 11 as in the embodiment of FIGS. 1-5 is not provided. In stead, a swing member 5 directly moves the intake valve 11 upward and downward to open and close the intake valve 11.

As shown in FIGS. 6 through 8, the swing member 5 can be formed in the shape of a comma or crescent shaped head. The swing member 5 can be fitted on the peripheral surface of a rocking shaft 4 and supported to be rockable about the center axis O2 of the rocking shaft 4.

More specifically, as shown in FIG. 8, the swing member 5 includes a cam surface 5*a* having a base circle portion 5*c*, a lift portion 5*d* and a ramp portion 5*e*. A width L1 of a contact surface of the base circle portion 5*c* is formed smaller than a width L2 of a contact surface of the lift portion 5*d*. Further, the bottom end of the swing member 5 is formed with a cam surface 5*a*. The cam surface 5*a* is curved toward the intake valve 11 to form a projection, and depresses a lifter 26 of the intake valve 11 to vertically move the intake valve 11. The upper portion of the cam surface 5*a* is formed with a guide portion 5*b*, along which a roller shaft 7 having a roller 8 slides.

In general, the lift portion 5*d* is configured to contact the intake valve 11 while the intake valve 11 valve is an open position and the arc-shaped base circle portion 5*c* is configured to contact the intake valve 11 when the valve 11 is closed or substantially closed. Advantageously, as shown in FIG. 8, a width L1 of a contact surface of the base circle portion 5*c* is smaller than a width L2 of a contact surface of the lift portion 5*d*. In one embodiment, the width L1 of the base circle portion 5*c* is at least 50% smaller than the width L2 than the lift portion 5*d*.

The roller shaft 7 is connected to one end portion 10*a* of an arm 10 connected to a drive shaft 9. A roller 8 rotatably supported with the roller shaft 7 comes into contact with a rotating cam 3.

The rocking shaft 4 can be provided with a spring or biasing member (not shown) for urging the swing member 5 toward the rotating cam 3. The swing member 5 is thereby urged toward the rotating cam 3 by the urging force of the spring, so that the peripheral surface of the roller shaft 7 is normally in contact with the guide portion 5*b*, and the peripheral surface of the roller 8 is normally in contact with a base surface 3*a* or a nose surface 3*b* of the rotating cam 3.

There can be provided, below the cam surface 5*a* of the swing member 5, the lifter 26 attached on the intake valve 11. Thus, the swinging motion of the swing member 5 directly moves the intake valve 11 upward and downward.

Thus, when the rocking shaft 4 is rotated by a predetermined angle by the actuator, the drive shaft 9 provided to the rocking shaft 4 is turned by a predetermined angle about the center axis O2 of the rocking shaft 4, and the roller shaft 7 is operated in synchronization with this turning movement through the arm 10. The roller shaft 7 can be thus moved within the guide portion 5*b* while keeping the distance between the center axis O3 of the roller shaft 7 and the center axis O4 of the drive shaft 9 constant with the arm 10, whereby the relative distance between the center axis O2 of the rocking shaft 4 and the roller 8 can be made variable. Therefore, the lift amount and the maximum lift timing of the intake valve 11 can be adjusted and made variable.

As shown in FIG. 6, when the roller shaft 7 is displaced to the distal end portion of the guide portion 5*b* so that the relative distance between the center axis O2 of the rocking shaft 4 and the roller 8 is made variable, the intake valve 11 is depressed with the cam surface 5*a* of the swing member 5 by a larger amount. A maximum lift amount is thus obtained.

As shown in FIG. 7, when the roller shaft 7 is displaced to the rocking shaft 4 side of the guide portion 5*b* so that the relative distance between the center axis O2 of the rocking shaft 4 and the roller 8 is made variable, the intake valve 11 is depressed with the cam surface 5*a* of the swing member 5 by a smaller amount. A minimum lift amount is thus obtained.

Further, although the width L1 of the base circle portion 5*c* is small, as in the Embodiment described above, since no large load acts on this portion, a requisite strength can be secured for the base circle portion 5*c*. Because a large load acts on the lift portion 5*d*, the width L2 thereof is made larger to secure a requisite strength.

Weight of the swing member 5 can be reduced because of the small width L1 of the base circle portion 5*c*. This results in a reduction in inertia force of the swing member 5 at the time of rocking movement, as well as in a reduction in weight of parts associated with the swing member 5 (e.g. spring 15). This allows the whole system to be smaller while reducing wear on a contact portion of the cam surface 5*a*.

Otherwise, this embodiment can be of the same or substantially similar construction and operation as the embodiment of FIGS. 1-5.

Figure 9:
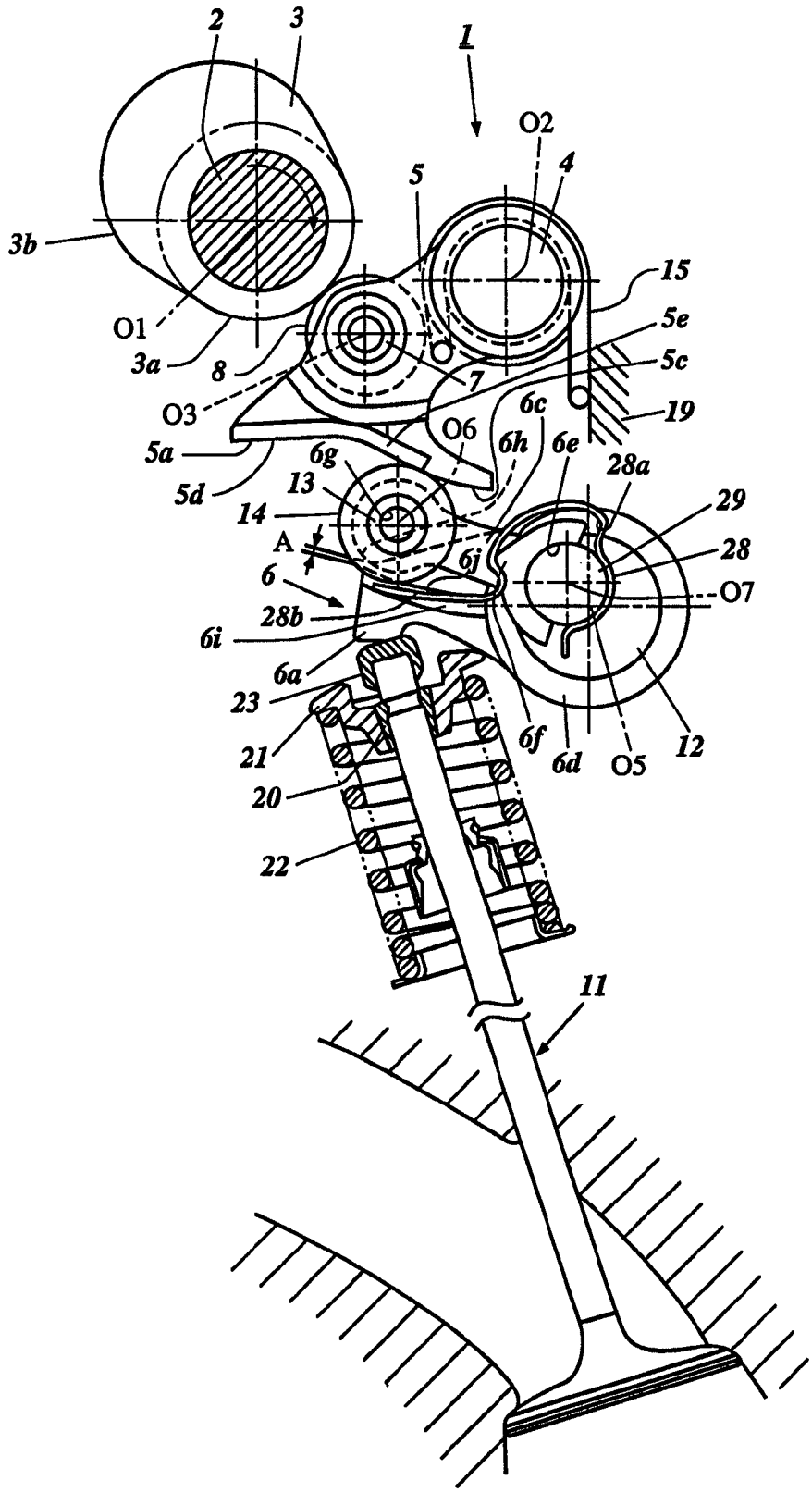
FIG. 9 is a cross-sectional side view of another embodiment of a variable valve mechanism in a state in which maximum lift amount is required and the intake valve is closed.
Figure 10A:
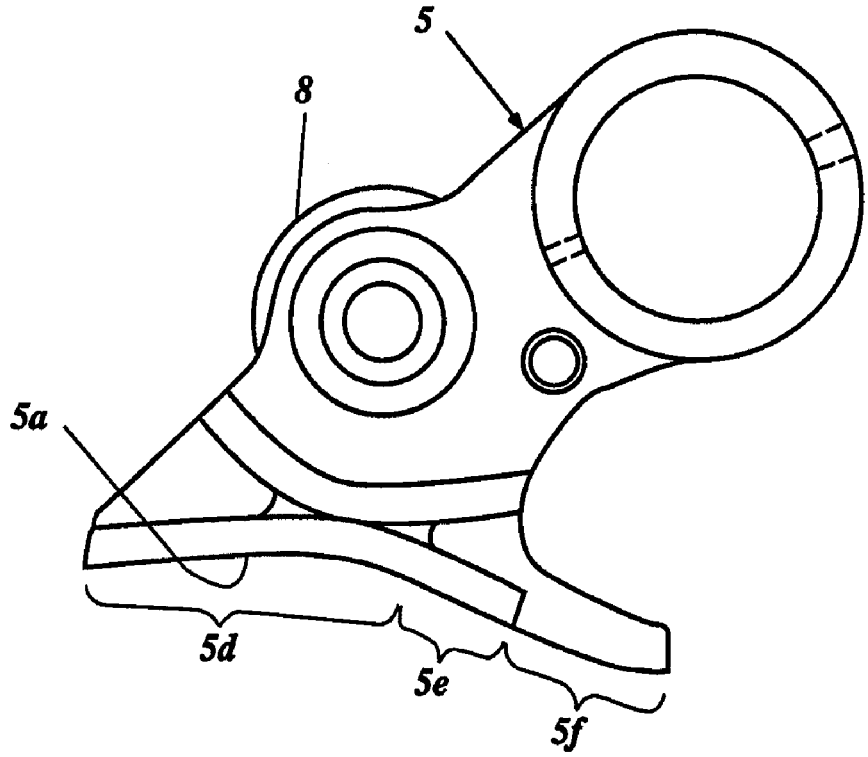
FIGS. 10(*a*) and 10(*b*) are front and bottom views of a swing member of the variable valve mechanism of FIG. 9.
Figure 10B:
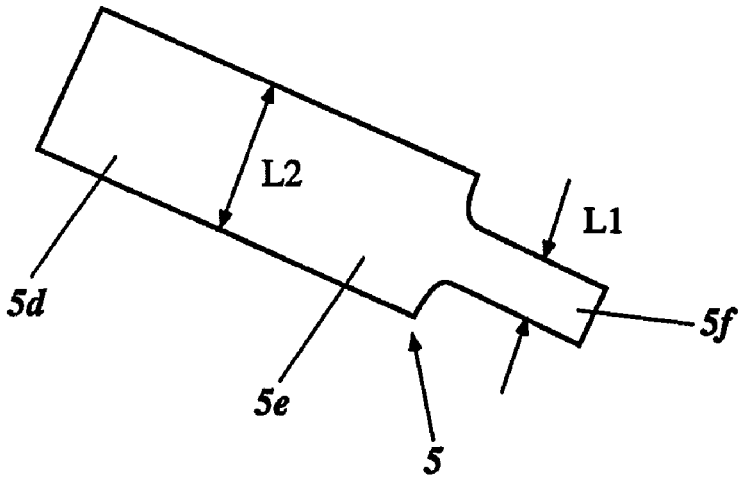
Figure 11:
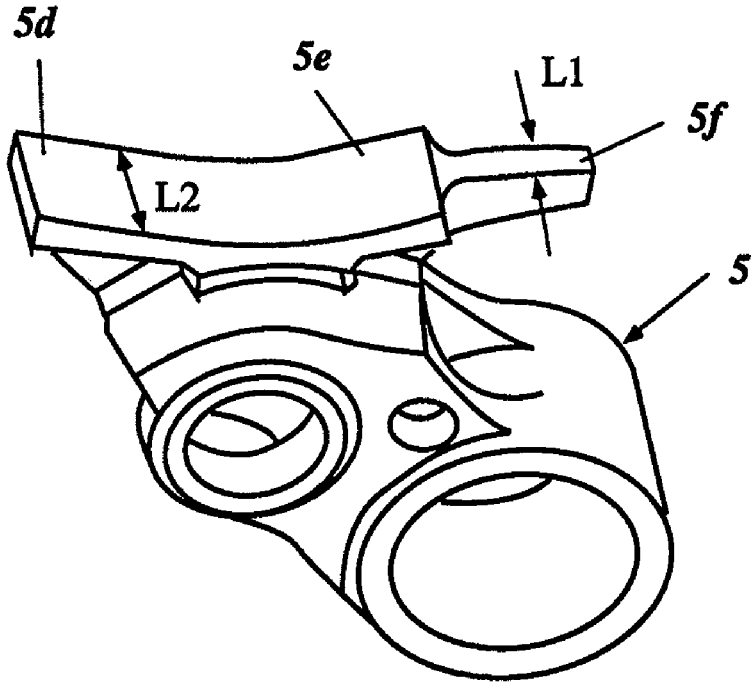
FIG. 11 is a bottom perspective view of the swing member of FIGS. 10(*b*) and 10(*b*).

FIGS. 9 through 11 are cross-sectional side views of another embodiment of a valve mechanism.

In this embodiment, a rocker arm 6 has a roller 14 that comes into contact with a cam surface 5*a* of a rocking cam 5, a roller arm 6*c* for supporting the roller 14, which is operated in synchronization with the rocking motion of the swing member 5, and a rocker arm main body 6*d* that rocks in synchronization with the roller arm 6*c* to vertically move an intake valve 11.

A leaf spring or other biasing member 28 can be used to urge the roller arm 6*c* to the swing member 5 side to bring the roller 14 and the cam surface 5*a* of the swing member 5 into contact with each other.

As shown in FIG. 10, as in the embodiments described above, the cam surface 5*a* has a base circle portion 5*f*, a lift portion 5*d*, and a ramp portion 5*e*, and a width L1 of the base circle portion 5*f* is formed smaller than a width L2 of the lift portion 5*d*. In general, the lift portion 5*d* is configured to contact the roller 14 while the intake valve 11 valve is an open position and the base circle portion 5*f* is configured to contact the intake valve 11 when the valve 11 is closed or substantially closed. Advantageously, as shown in FIG. 10, a width L1 of a contact surface of the base circle portion 5*f* is smaller than a width L2 of a contact surface of the lift portion 5*d*. In one embodiment, the width L1 of the base circle portion 5*c* is at least 50% smaller than the width L2 than the lift portion 5*d*.

Further, the roller arm 6*c* is freely movable to a predetermined position. By changing the contact position between the roller 14 provided to the roller arm 6*c* and the cam surface 5*a* of the swing member 5, the life amount of each valve or the like can be adjusted.

Specifically, as shown in FIG. 9, an eccentric shaft 29 is fixedly provided to the rocker arm shaft 12 in such a manner that a center axis O7 thereof is located in parallel and eccentrically to the center axis O5 of the rocker arm shaft 12. The roller arm 6*c* of the rocker arm 6 is rotatably locked onto the eccentric shaft 29 by the leaf spring 28.

The roller arm 6*c* has an engaging portion 6*e* formed at its one end. The engaging portion 6*e* engages with the outer peripheral surface of the eccentric shaft 29, and is so shaped as to be capable of sliding on the outer peripheral surface of the eccentric shaft 29. Formed at a position adjacent to the engaging portion 6*e* is a fitting engagement portion 6*f* with which the leaf spring 28 for integrally locking the roller arm 6*c* and the eccentric shaft 29 in place is brought into fitting engagement so as to prevent dislodging thereof. Further, a through-hole 6*g*, with which the roller shaft 13 supporting the roller 14 that slides on the cam surface 5*a* of the swing member 5 is brought into fitting engagement, is formed at the other end of the roller arm 6*c*. Formed below the through-hole 6*g* is a pressing portion 6*h* for pressing the rocker arm main body 6*d* to the intake valve 11 side when the roller arm 6*c* rocks to the intake valve 11 side in synchronization with the rocking motion of the swing member 5.

Further, the rocker arm main body 6*d* of the rocker arm 6 is rockably supported and arranged on the rocker arm shaft 12, and has the valve pressing portion 6*a* formed at is distal end portion. The valve pressing portion 6*a* presses on the upper surface of the shim 23 fitted on the intake valve 11. Further, a contact surface 6*i* with which a distal end portion 28*b* of the leaf spring 28, which will be described later, comes into contact is formed above the valve pressing portion 6*a*, and a guide portion 6*j* pressed on by the pressing portion 6*h* formed in the rocker arm 6*c* is formed above the contact surface 6*i*.

Further, the leaf spring 28 is formed into a predetermined configuration by bending a planar spring at several locations. More specifically, the leaf spring 28 is formed in a configuration allowing fitting engagement with the fitting engagement portion 6*f* of the roller arm 6*c* and with the eccentric shaft 29, and has formed therein a locking portion 28*a* for integrally locking the roller arm 6*c* and the eccentric shaft 29 onto each other. Further, the distal end portion 28*b* of the leaf spring 28 on the roller arm 6*c* side extends to the roller 14 side and comes into contact with the contact surface 6*i* formed in the rocker arm main body 6*d*.

Further, the leaf spring 28 is formed in such a configuration as to urge the roller arm 6*c* and the rocker arm main body 6*d* to spread out from each other when the roller arm 6*c* and the eccentric shaft 29 are integrally locked onto each other by the locking portion. 28*a*.

A predetermined clearance A can be provided between a pressing portion 6*h* of the roller arm 6*c* and a guide portion 6*j* of the rocker arm main body 6*d*.

Thus, since the roller arm 6*c* is integrally locked onto the eccentric shaft 29 by the leaf spring 28 so that the roller arm 6*c* can slide on the outer peripheral surface of the eccentric shaft 29, when the swing member 5 is rocked, the roller arm 6*c* is caused via the roller 14 and the roller shaft 13 to rock to the intake valve 11 side against the urging force of the leaf spring 28. Further, as the rocker arm 6*c* is rocked to the intake valve 11 side, the pressing portion 6*h* of the roller arm 6*c* presses on the guide portion 6*j* of the rocker arm main body 6*d*, causing the rocker arm main body 6*d* to rock to the intake valve 11 side, thereby making it possible to open and close the intake valve 11.

Further, the roller arm 6*c* is urged to the swing member 5 side by the leaf spring 28, so the outer peripheral surface of the roller 14 provided to the roller arm 6*c* is held in constant contact with the cam surface 5*a* of the swing member 5.

Further, an actuator (not shown) for rotating the rocker arm shaft 12 within a predetermined angle range about the center axis O5 is connected to one end portion of the rocker arm shaft 12. Connected to the actuator is a control device (not shown) for controlling the angle of the actuator according to the operational state of the internal combustion engine.

Thus, when the rocker arm shaft 12 is rotated by a predetermined angle by the actuator, the eccentric shaft 29 provided to the rocker arm shaft 12 is turned by a predetermined angle about the center axis O5 of the rocker arm shaft 12. Further, when the eccentric shaft 29 is turned by the predetermined angle, the roller arm 6*c* operating in synchronization therewith is moved, for example, from the position indicated by the solid line in FIG. 9 to a predetermined position indicated by the chain double-dashed line in FIG. 9. Then, once the roller arm 6*c* has been moved to the predetermined position, the contact point where the cam surface 5*a* of the swing member 5 and the roller 14 provided to the roller arm 6*c* come into contact with each other changes. The rocking amount of the rocker arm main body 6*d* can be thus changed, which makes it possible to adjust the lift amount or the like of the intake valve 11 that is vertically moved by the rocker arm 6.

Further, even in the case where a predetermined clearance is not provided between the valve pressing portion 6*a* of the rocker arm main body 6*d* and the intake valve 11, the predetermined clearance (A) provided between the pressing portion 6*h* and the guide portion 6*j* allows the intake valve 11 to be reliably opened/closed even when, due to a rise in the temperature of the internal combustion engine, the intake valve 11 undergoes thermal expansion to cause upward jumping of the valve.

Also with the valve mechanism 1 for an internal combustion engine constructed as described above, in which the lift amount or the like of each valve can be adjusted by making the roller arm 6*c* be movable to the predetermined position and changing the contact position between the roller 14 provided to the roller arm 6*c* and the cam surface 5*a* of the swing member 5, the roller arm 6*c* is urged toward the swing member 5 side by the leaf spring 28. Accordingly, when the roller arm 6*c* has been moved to the predetermined position and the contact position between the roller 14 and the cam surface 5*a* changes, the roller 14 of the rocker arm 6 and the cam surface 5*a* of the swing member 5 constantly come into contact with each other, thereby making it possible to prevent adhesive wear.

Further, although the width L1 of the base circle portion 5*c* is small, as in the embodiments described above, since no large load acts on this portion, a requisite strength can be secured for the base circle portion 5*c*. Because a large load acts on the lift portion 5*d*, the width L2 thereof is made larger to secure a requisite strength.

Weight of the swing member 5 can be reduced because of the small width L1 of the base circle portion 5*c*. This results in a reduction in inertia force of the swing member 5 at the time of rocking movement, as well as in a reduction in weight of parts associated with the swing member 5 (e.g. spring 15).

Particularly, the base circle portion 5*c* is formed in a position apart from the center axis O2, and therefore can more contribute to the reduced inertia force.

Otherwise, this embodiment can be of the same or substantially similar construction and operation as Embodiment 1 of the present invention, so repetitive description will not be repeated.

Figure 12:
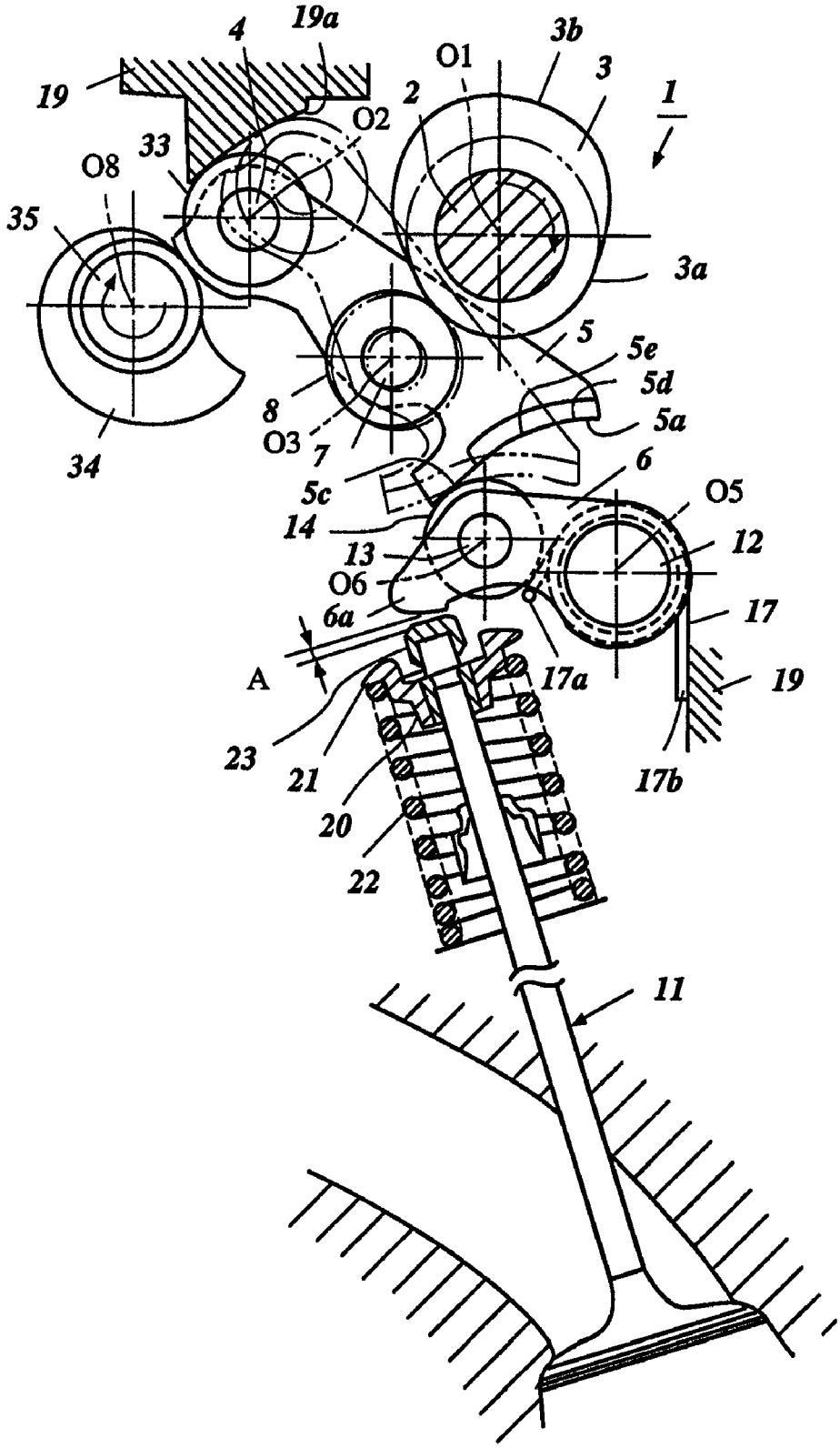
FIG. 12 is a cross-sectional side view of another embodiment of a variable valve mechanism in which the intake valve is closed.
Figure 13A:
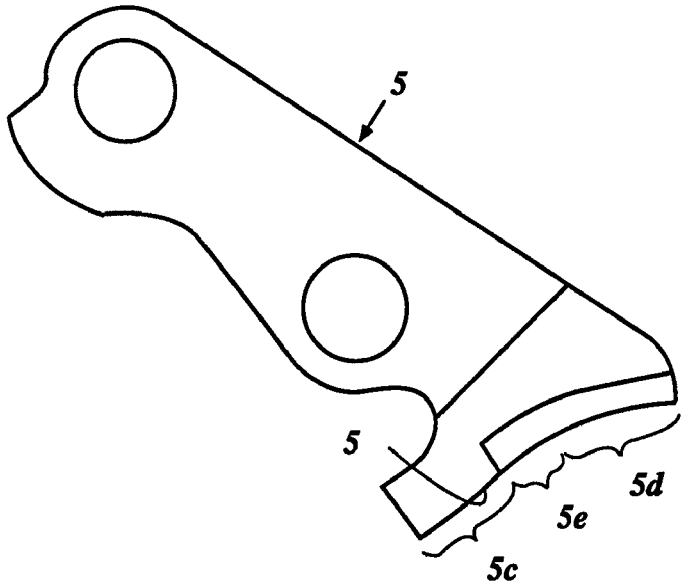
FIGS. 13(*a*) and 13(*b*) are front and bottom views of a swing member of the variable valve mechanism of FIG. 12.
Figure 13B:
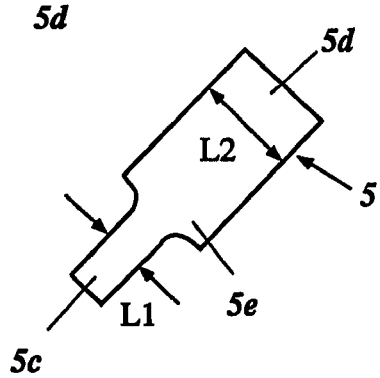

FIGS. 12 and 13 are cross-sectional side views of a valve mechanism according to another embodiment 4. In these figures, the intake valve 11 is in a closed position.

The valve mechanism 1 for an internal combustion engine according this embodiment is capable of adjusting the lift amount or the like of each valve by making the rocking shaft 4 movable to a predetermined position.

Specifically, as shown in FIG. 12, a roller 33 is arranged on the outer peripheral surface of the rocking shaft 4. The roller 33 is in contact with a guide portion 19*a* formed in the cylinder head main body 19 for guiding the rocking shaft 4 to a predetermined position. Further, the rocking shaft 4 is provided to the cylinder head main body 19 such that, when the swing member 5 is pressed by a control cam 34 that will be described next, the rocking shaft 4 can move in synchronization with the swing member 12 within a range from a position indicated by the solid line in FIG. 12 to that indicated by the chain double-dashed line in FIG. 12.

The control cam 34 is fixed onto the outer peripheral surface of a control shaft 35 provided in parallel to the camshaft 2. Further, the outer peripheral portion of the control cam 34 contacts the swing member 5 and is formed in a configuration allowing the rocking shaft 4 to be guided to a predetermined position by rotating the control cam 34 in a predetermined angle.

As shown in FIG. 13, the cam surface 5*a* of the swing member 5 has a base circle portion 5*c*, a lift portion 5*d*, and a ramp portion 5*e*, and a width L1 of the base circle portion 5*c* is formed smaller than a width L2 of the lift portion 5*d*. In general, the lift portion 5*d* is configured to contact the roller 14 while the intake valve 11 valve is an open position and the base circle portion 5*c* is configured to contact the roller 14 when the valve 11 is closed or substantially closed. Advantageously, as shown in FIG. 13, a width L1 of a contact surface of the base circle portion 5*c* is smaller than a width L2 of a contact surface of the lift portion 5*d*. In one embodiment, the width L1 of the base circle portion 5*c* is at least 50% smaller than the width L2 than the lift portion 5*d*.

An actuator (not shown) for rotating the control shaft 35 within a predetermined angle range about a center axis O8 of the control shaft 35 is connected to one end portion of the control shaft 35. Connected to the actuator is control device (not shown) for controlling the angle of the actuator according to the operational state of the internal combustion engine.

The rocker arm 6, which makes reciprocating motion while rocking within a predetermined range in synchronization with the swing member 5, is of the same construction as that of the embodiment of FIGS. 1-5. That is, the rocker arm 6 has the valve pressing portion 6*a* formed therein, is provided with the roller shaft 13 and the roller 14, and is rockably supported on the rocker arm shaft 12.

Further, as in the embodiment of FIGS. 1-5, the rocker arm shaft 12 is provided with the torsion spring or biasing member 17 as a spring member for bringing the roller 14 and the cam surface 5*a* into constant contact with each other.

Thus, when the control shaft 35 is turned by a predetermined angle by the actuator, the control cam 34 is rotated by a predetermined angle about the center axis O8 of the control shaft 35. When the control cam 34 is rotated by the predetermined angle, by the control cam 34, the roller 33 is caused via the swing member 5 to slide on the guide portion 19*a* of the cylinder head main body 19 so as to be moved, for example, from the position indicated by the solid line in FIG. 12 to a predetermined position indicated by the chain double-dashed line in FIG. 12. Then, as the rocking shaft 4 is moved, the position of the cam surface 5*a* of the swing member 5 changes. The rocking amount of the rocker arm 6 can be thus changed, which makes it possible to adjust the lift amount or the like of the intake valve 11 that is vertically moved by the rocker arm 6.

Also with the valve mechanism 1 constructed as described above, which makes the lift amount or the like of each valve variable by moving the rocking shaft 4 to a predetermined position, the rocker arm 6 is urged to the swing member 5 side by the torsion spring 17, so even when the rocking shaft 4 has been moved to the predetermined position, and the position of the cam surface 5*a* of the swing member 5 changes, the roller 14 of the rocker arm 6 and the cam surface 5*a* of the swing member 5 constantly come into contact with each other. Adhesive wear can be thus prevented or reduced.

Further, although the width L1 of the base circle portion 5*c* is small, as in the embodiments described above, since no large load acts on this portion, a requisite strength can be secured for the base circle portion 5*c*. Because a large load acts on the lift portion 5*d*, the width L2 thereof is made larger to secure a requisite strength.

Weight of the swing member 5 can be reduced because of the small width L1 of the base circle portion 5*c*. This results in a reduction in inertia force of the swing member 5 at the time of rocking movement, as well as in a reduction in weight of parts associated with the swing member 5 (e.g. spring 15). Particularly, the base circle portion 5*c*, formed in a position apart from the center axis O2, can more contribute to the reduced inertia force.

Otherwise, this embodiment can be of the same or similar construction and operation as the embodiment described above with reference to FIGS. 1-5, so repetitive description will not be repeated.

Figure 14:
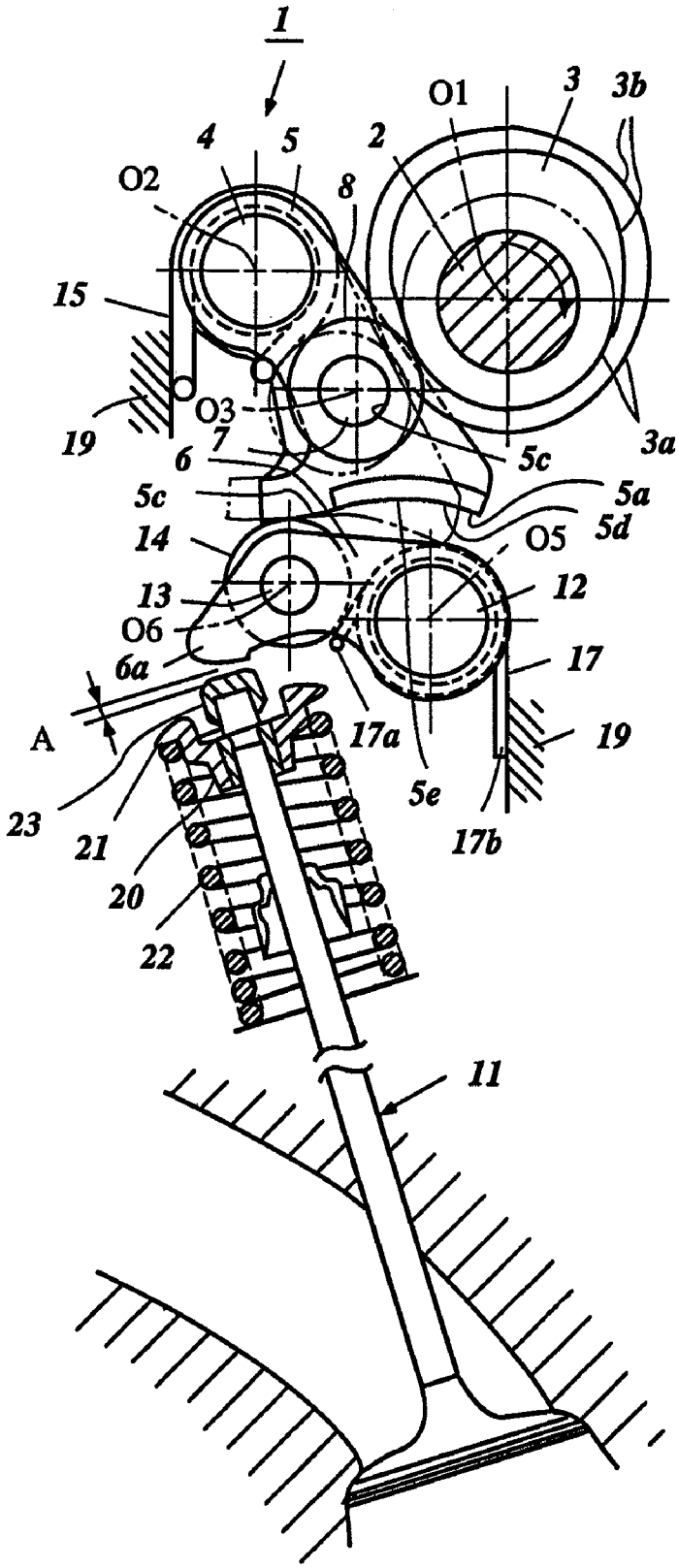
FIG. 14 is a cross-sectional side view of another embodiment of a variable valve mechanism in which the intake valve is closed.
Figure 15A:
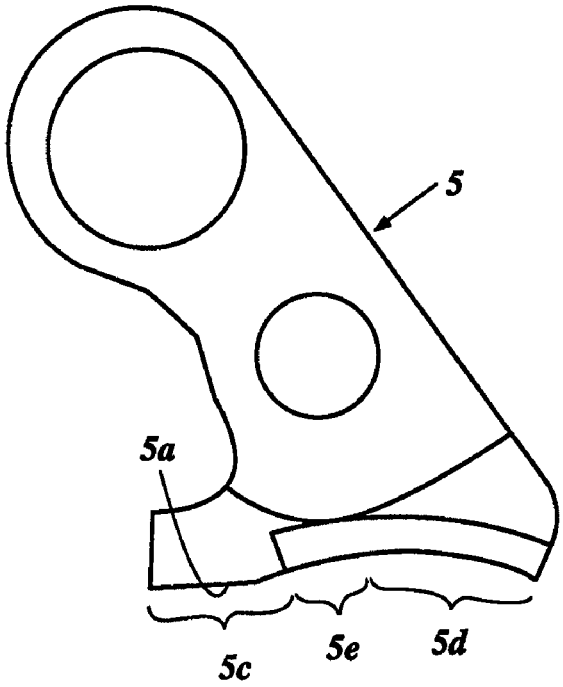
FIGS. 15(*a*) and 15(*b*) are front and bottom views of a swing member of the variable valve mechanism of FIG. 14.
Figure 15B:
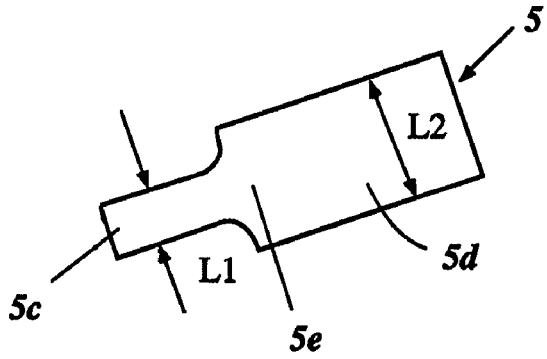

FIGS. 14 and 15 are cross-sectional views of yet another embodiment of a valve mechanism in a state in which the intake valve is closed.

In this embodiment, the rotating cam 3 has a tapered configuration, and the contact position between the outer peripheral portion of the rotating cam 3 and the swing member 5 is changed by moving the rotating cam 3 in the direction of the center axis O1 of the camshaft 2, thereby making it possible to adjust the lift amount or the like of each valve.

Specifically, as shown in FIG. 14, the rotating cam 3 is fixed onto the outer peripheral surface of the camshaft 2. The outer peripheral portion of the rotating cam 3 is constructed with the base surface 3*a* that is arc-shaped in plan view, and the nose surface 3*b* projecting from the base surface 3*a*. The base surface 3*a* and the nose surface 3*b* are formed in the tapered configuration in the direction of the center axis O1 (in the direction perpendicular to the sheet plane) of FIG. 14.

An actuator (not shown) for moving the camshaft 2 within a predetermined range in the direction of the center axis O1 is connected to one end portion of the camshaft 2. Connected to the actuator is control device (not shown) for controlling the angle of the actuator according to the operational state of the internal combustion engine.

Further, the outer peripheral surface of the roller 8 provided to the swing member 5 rocked by the rotating cam 3 is capable of sliding on the base surface 3*a* and base surface 3*b* of the rotating cam 3 formed in the tapered configuration.

Further, as shown in FIG. 15, the cam surface 5*a* of the swing member 5 has a base circle portion 5*c*, a lift portion 5*d*, and a ramp portion 5*e*, and a width L1 of the base circle portion 5*c* is formed smaller than a width L2 of the lift portion 5*d*. In general, the lift portion 5*d* is configured to contact the roller 14 while the intake valve 11 valve is an open position and the arc-shaped base circle portion 5*c* is configured to contact the roller 14 when the valve 11 is closed or substantially closed. Advantageously, as shown in FIG. 15, a width L1 of a contact surface of the base circle portion 5*c* is smaller than a width L2 of a contact surface of the lift portion 5*d*. In one embodiment, the width L1 of the base circle portion 5*c* is at least 50% smaller than the width L2 than the lift portion 5*d*.

Further, the rocker arm 6, which makes reciprocating motion while rocking within a predetermined range in synchronization with the swing member 5, is of the same construction as that of the previous embodiment. That is, the rocker arm 6 has the valve pressing portion 6*a* formed therein, is provided with the roller shaft 13 and the roller 14, and is rockably supported on the rocker arm shaft 12.

Further, as the previous embodiment, the rocker arm shaft 12 is provided with the torsion spring 17 for bringing the roller 14 and the cam surface 5*a* into constant contact with each other. Thus, when the camshaft 2 moves within a predetermined range in the direction of the center axis O1 by the actuator, the rotating cam 3 moves within a predetermine range in the direction of the center axis O1 of the camshaft 2. Since the rotating cam 3 is formed in the tapered configuration, when the rotating cam 3 is moved with the predetermined range, the swing member 5 is caused via the roller shaft 7 and the roller 8 to move, for example, from the position indicated by the solid line in FIG. 14 to a predetermined position indicated by the double-dashed chain line in FIG. 14. Then, when the swing member 5 has been moved to the predetermined position, the position of the cam surface 5*a* of the swing member 5 changes. Therefore, the rocking amount of the rocker arm 6 can be changed, which makes it possible to adjust the lift amount or the like of the intake valve 11 that is vertically moved by the rocker arm 6.

Also with the valve mechanism 1 constructed as described above, in which the rotating cam 3 is tapered, and the lift amount or the like of each valve variable is made variable by moving the rotating cam 3 in the direction of the center axis O1 of the camshaft 2 and changing the contact position between the outer peripheral portion of the rotating cam 3 and the swing member 5, the rocker arm 6 is urged to the swing member 5 side by the torsion spring 17, so even when the rocking shaft 4 has been moved to the predetermined position, and the position of the cam surface 5*a* of the swing member 5 changes, the roller 14 of the rocker arm 6 and the cam surface 5*a* of the swing member 5 constantly come into contact with each other. Adhesive wear can be thus prevented or reduced.

Further, although the width L1 of the base circle portion 5*c* is small, as in the Embodiments described above, since no large load acts on this portion, a requisite strength can be secured for the base circle portion 5*c*. Because a large load acts on the lift portion 5*d*, the width L2 thereof is made larger to secure a requisite strength.

Weight of the swing member 5 can be reduced because of the small width L1 of the base circle portion 5*c*. This results in a reduction in inertia force of the swing member 5 at the time of rocking movement, as well as in a reduction in weight of parts associated with the swing member 5 (e.g. spring 15). Particularly, the base circle portion 5*c* is formed in a position apart from the center axis O2, and therefore can more contribute to the reduced inertia force.

Otherwise, this embodiment is of the same construction and operation as the embodiment of FIGS. 1-5, so repetitive description will not be repeated.

It should be noted that while, in the Embodiments described above, the present invention is applied to the variable valve mechanism 1 provided with the swing member 5, the present invention is not limited to this construction. The present invention may also be applied to any valve mechanism incapable of changing the lift amount or the like.

It should be appreciated that according to one embodiment of the invention a swing member includes the cam surface having a base circle portion and a lift portion. The swing member reciprocally disposed. The width of the contact surface of the base circle portion is smaller than the width of the contact surface of the lift portion. Advantageously, the weight of the swing member can be reduced. This can result in a reduction in inertia force of the swing member at the time of rocking movement, as well as in a reduction in weight of parts associated with the swing member.

In another embodiment, the valve mechanism for an internal combustion engine, is capable of changing the lift amount of the intake valve or the exhaust valve of the internal combustion engine. The valve mechanism is provided with a swing member having a base circle portion and a lift portion. The width of the contact surface of the base circle portion is smaller than the width of the contact surface of the lift portion. This can result in a reduction in inertia force of the swing member at the time of rocking movement, as well as in a reduction in weight of parts associated with the swing member.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A valve drive mechanism for actuating a valve of an internal combustion engine, the valve drive mechanism comprising:

a camshaft rotated by a crankshaft of the internal combustion engine;

a cam coupled to the camshaft;

a swing member support shaft positioned substantially in parallel to the camshaft;

a swing member supported for pivotal motion on the swing member support shaft and configured to be actuated for reciprocal motion by the cam, wherein the swing member includes a cam surface comprising a base circle portion and a lift portion and wherein a width of the base circle portion of the cam surface is smaller than a width of the lift portion of the cam surface, and a variable valve timing mechanism that is configured to varying a lift amount of an intake valve or an exhaust valve of the internal combustion engine;

wherein the variable valve mechanism comprises a movable cam abutment portion that contacts the cam to transmit a drive force from the cam to the swing member and the swing member comprises a guide portion that is configured to guide the cam abutment portion in a certain direction and wherein the drive force from the cam is transmitted to the guide portion through the cam abutment portion to cause the swing member to pivot on the rocking shaft.

2. The valve drive mechanism of claim 1, further comprising a variable abutment portion mechanism that is configured to vary a relative distance between the cam abutment portion and a center axis of the swing member support shaft.

3. The valve drive mechanism of claim 2, wherein the relative distance between the cam abutment portion and the center axis of the swing member support shaft is varied by moving the cam abutment portion along the guide portion.

4. The valve drive mechanism of claim 3, wherein the width of the base circle portion of the cam surface is at least 50% smaller than the width of the lift portion of the cam surface.

5. The valve drive mechanism of claim 2, wherein the width of the base circle portion of the cam surface is at least 50% smaller than the width of the lift portion of the cam surface.

6. The valve drive mechanism of claim 1, wherein the width of the base circle portion of the cam surface portion is at least 50% smaller than the width of the first portion of the cam surface.

7. The valve drive mechanism of claim 1, further comprising a displacement mechanism configured to displace a contact point between the cam surface and the swing member.

8. The valve drive mechanism of claim 1, wherein the camshaft is the camshaft for the intake valve of the internal combustion engine.

9. The valve drive mechanism of claim 1, wherein the camshaft is the camshaft for the exhaust valve of the internal combustion engine.

* * * * *